US010683991B2

(12) United States Patent
Lin

(10) Patent No.: US 10,683,991 B2
(45) Date of Patent: Jun. 16, 2020

(54) EXTENSIBLE LAMP TO REDUCE SHADOW

(71) Applicant: LEDVANCE GmbH, Garching bei München (DE)

(72) Inventor: Jing Lin, Shenzhen Guangdong (CN)

(73) Assignee: LEDVANCE GMBH, Garching Bei München (DE)

( * ) Notice: Subject to any disclaimer, the term of this patent is extended or adjusted under 35 U.S.C. 154(b) by 0 days.

(21) Appl. No.: 16/045,988

(22) Filed: Jul. 26, 2018

(65) Prior Publication Data

US 2019/0032892 A1 Jan. 31, 2019

(30) Foreign Application Priority Data

Jul. 26, 2017 (CN) ..... 2017 1 06191665

(51) Int. Cl.

| | |
|---|---|
| ***F21V 14/02*** | (2006.01) |
| ***F21V 19/00*** | (2006.01) |
| ***F21K 9/20*** | (2016.01) |
| ***F21S 8/06*** | (2006.01) |
| ***F21S 6/00*** | (2006.01) |
| ***F21V 21/34*** | (2006.01) |
| *F21Y 115/10* | (2016.01) |
| *F21V 21/35* | (2006.01) |

(52) U.S. Cl.

CPC ..... *F21V 14/02* (2013.01); *F21K 9/20* (2016.08); *F21S 6/003* (2013.01); *F21S 8/06* (2013.01); *F21S 8/061* (2013.01); *F21V 19/0045* (2013.01); *F21V 21/34* (2013.01); *F21V 21/35* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 1,865,179 | A | 6/1932 | Egli |
| 2,352,496 | A | 6/1944 | Rose |
| 6,416,207 | B1 | 7/2002 | Chang |
| 6,450,668 | B1 | 9/2002 | Kotloff |
| 9,383,508 | B2 | 7/2016 | Getzinger et al. |
| 2006/0291204 | A1 | 12/2006 | Marka et al. |
| 2008/0170398 | A1 | 7/2008 | Kim |
| 2008/0212329 | A1 | 9/2008 | Duguay et al. |
| 2012/0140473 | A1 | 6/2012 | Chang |
| 2012/0140474 | A1 | 6/2012 | Jurik et al. |
| 2012/0300437 | A1 | 11/2012 | Lu et al. |
| 2013/0141914 | A1 | 6/2013 | Lai et al. |
| 2015/0354794 | A1 | 12/2015 | Guercio et al. |
| 2017/0216616 | A1 | 8/2017 | Boyajian et al. |
| 2018/0324924 | A1* | 11/2018 | Van De Sluis .... H05B 37/0218 |
| 2019/0032868 | A1 | 1/2019 | Jiang |
| 2019/0032892 | A1 | 1/2019 | Lin |

* cited by examiner

*Primary Examiner* — Elmito Breval

(74) *Attorney, Agent, or Firm* — Hayes Soloway PC

(57) ABSTRACT

A lighting device includes a primary lighting module with one or more light sources and one or more secondary lighting modules each with one or more light sources. Each secondary lighting module is mechanically and electrically connected to the primary lighting module. At least one of the secondary lighting modules is movable with respect to the primary lighting module. The shape of the lighting device can be varied between a collapsed state requiring less space and an expanded state for the reduction of shadows.

20 Claims, 3 Drawing Sheets

EXTENSIBLE LAMP TO REDUCE SHADOW

CROSS-REFERENCE TO RELATED APPLICATIONS AND PRIORITY

This patent application claims priority from Chinese Patent Application No. 2017106191665 filed Jul. 26, 2017, which is herein incorporated by reference in its entirety.

TECHNICAL FIELD

The present invention relates to a lighting device having a variable shape.

BACKGROUND

Currently, many lighting devices, for example table lamps or ceiling lamps, have a rather small area of light emission. In particular when used for illuminating a working area, such as a writing desk, shadows generated by hands, tools, etc. located between the lighting device and the working area are very dark as compared to the otherwise illuminated region.

While lighting devices having a larger area of light emission exist, they usually require more space and/or are aesthetically unpleasing, especially when not in use.

SUMMARY OF THE INVENTION

In view of the known prior art, it is an object of the present invention to provide a lighting device that allows the reduction of shadows while overcoming the disadvantages mentioned above.

This object is solved by a lighting device according to the present invention as defined by the independent claim. Preferred embodiments are given by the dependent claims.

A lighting device according to the present invention comprises a primary lighting module and one or more secondary lighting modules. The lighting device may comprise 1, 2, 3, 4 or more secondary light sources.

The primary lighting module and each of the secondary lighting modules comprises one or more light sources. While any known light source may be employed, using semiconductor light sources, for example LEDs, is especially preferred. The light sources of each lighting module (primary and secondary) may be mounted in the lighting module individually or as a unit, e.g. using a carrier carrying the light sources, for example on a printed circuit board (PCB).

Each secondary lighting module is mechanically and electrically connected to the primary lighting module. The primary lighting module may comprise an attachment structure for attaching the lighting device to a holder, for example a stand for a desk lamp or a hanging mount for a ceiling lamp. The mechanical connection between primary lighting module and secondary lighting module(s) thus also achieves a mounting of the secondary lighting module(s).

The primary lighting module may comprise electrical connectors (e.g. terminals or cables) for supplying the lighting device with electrical power. The electrical power can be transferred to the secondary lighting module(s) via the electrical connection(s).

An electronic driver (if necessary) may be provided in the primary lighting module, such that electrical power with the required operating parameters (e.g. voltage, current) can be provided via the electrical connections. An electronic driver may also be provided in each of the primary and secondary lighting modules, such that electrical mains power is provided via the electrical connections and electrical power with the required operating parameters is provided for each lighting module by the respective driver.

At least one of the secondary lighting modules is movable with respect to the primary lighting module. For example, a secondary lighting module may be movable between a first position close to the primary lighting module and a second position apart from the primary lighting module.

If more than one secondary lighting module is used, each secondary lighting module may be moved individually. Alternatively, the movement of the secondary lighting modules may be synchronized, e.g. by a synchronization mechanism.

Different secondary lighting modules may have different degrees of freedom for their movement. For example, they may be movable in different directions and/or they may be movable for different distances.

In an embodiment, the lighting device comprises four secondary lighting modules which are located on four sides of the primary lighting module. Each secondary lighting module may be movable between a first position close to the primary lighting module and a second position apart from the primary lighting module.

In an embodiment, the at least one secondary lighting module is connected to the primary lighting module using a slide connection. This allows a sliding movement of the secondary lighting module with respect to the primary lighting module.

The slide connection may comprise a sliding element (also called a sliding block) and a slide track on the primary lighting module and/or the at least one secondary lighting module. The slide tracks on the primary and/or secondary lighting module are adapted to slidingly receive the sliding element.

Preferably, the lighting device comprises a sliding element and a slide track on the primary lighting module and the at least one secondary lighting module. Moving a secondary lighting module with respect to the primary lighting module then involves moving the sliding element with respect to the primary lighting module in the slide track of the primary lighting module and moving the secondary lighting module with respect to the sliding element by moving the slide track of the secondary lighting module along the sliding element.

These movements may be carried out simultaneously (in particular synchronized) or one after the other.

Such a configuration allows for a compact design of the lighting device when the primary lighting module and the secondary lighting module are located next to each other while also allowing for a significant separation between the primary lighting module and the secondary lighting module.

Alternatively, the sliding element may be fixed to the primary lighting module (e.g., it may be part of the housing of the primary lighting module) and only the secondary lighting module may be provided with a slide track adapted to slidingly receive the sliding element. Also alternatively, the sliding element may be fixed to the secondary lighting module (e.g., it may be part of the housing of the secondary lighting module) and only the primary lighting module may be provided with a slide track adapted to slidingly receive the sliding element.

In an embodiment, the sliding element and the slide tracks comprise corresponding electrical contacts for providing an electrical connection between the primary lighting module and the secondary lighting module.

For example, the slide tracks may be provided with contact strips and the sliding element may be provided with corresponding contact elements. The contact elements may be adapted to glide along the contact strips during the sliding motion. The sliding element may be provided with an electrical connection between the contact elements on both sides of the sliding element (inside the sliding element or on the outside of the sliding element). The contact elements may be resiliently biased against the contact strips.

In an embodiment, the sliding element and the slide tracks comprise stoppers adapted to interact with each other in order to limit the range of relative movement between the primary lighting module and the at least one secondary lighting module. Such stoppers may prevent the sliding element from leaving the slide tracks and, thus, the lighting device from falling apart. The stoppers may comprise one or more protrusions on each sliding element and on the corresponding slide track adapted to abut each other at the end of the designed motion range.

In an embodiment, the at least one secondary lighting module is movable between a collapsed state of the lighting device and an expanded state of the lighting device. "Collapsed state" herein means that the secondary lighting module(s) is/are in the position closest to the primary lighting module. "Expanded state" herein means that the secondary lighting module(s) is/are in the position furthest apart from the primary lighting module. Preferably, the effective area of light emission in the collapsed state is smaller than the effective area of light emission in the expanded state. "Effective area of light emission" herein means the area defined by the dimensions of the lighting device, usually by the outer edges of the secondary lighting modules. Thus, an effective area of light emission may include areas between the lighting modules where no light emission occurs.

Increasing the effective area of light emission by bringing the lighting device into the expanded state illuminates a working area from a broader range of directions and, thus, weakens the shadows generated by a hand or tool between the lighting device and the working area.

In an embodiment, the effective area of light emission in the expanded state is at least twice, preferably at least five times the effective area of light emission in the collapsed state. This allows for a noticeable weakening of shadows while also keeping the overall dimensions of the lighting device in the collapsed state small and ensuring a sufficient stability of the lighting device in the expanded state.

In an embodiment, the shapes of the primary lighting module and of the at least one secondary lighting module are designed such that the primary lighting module and the at least one secondary lighting module abut each other in the collapsed state of the lighting device without any gaps therebetween. Such a configuration also allows for keeping the overall dimensions of the lighting device in the collapsed state small. Also, in the collapsed state, a high illumination intensity may be achieved, which may be required for certain applications.

BRIEF DESCRIPTION OF THE DRAWINGS

Preferred embodiments of the invention will be explained in the following, having regard to the drawings. It is shown in FIGS. 1*a* and 1*b* schematic views of an embodiment of a ceiling lamp according to the present invention.

DETAILED DESCRIPTION OF THE INVENTION

In the following, preferred embodiments of the invention will be described with reference to the drawings. The same or similar elements or elements having the same effect may be indicated by the same reference number in multiple drawings. Repeating the description of such elements may be omitted in order to prevent redundant descriptions.

Figure 1A:
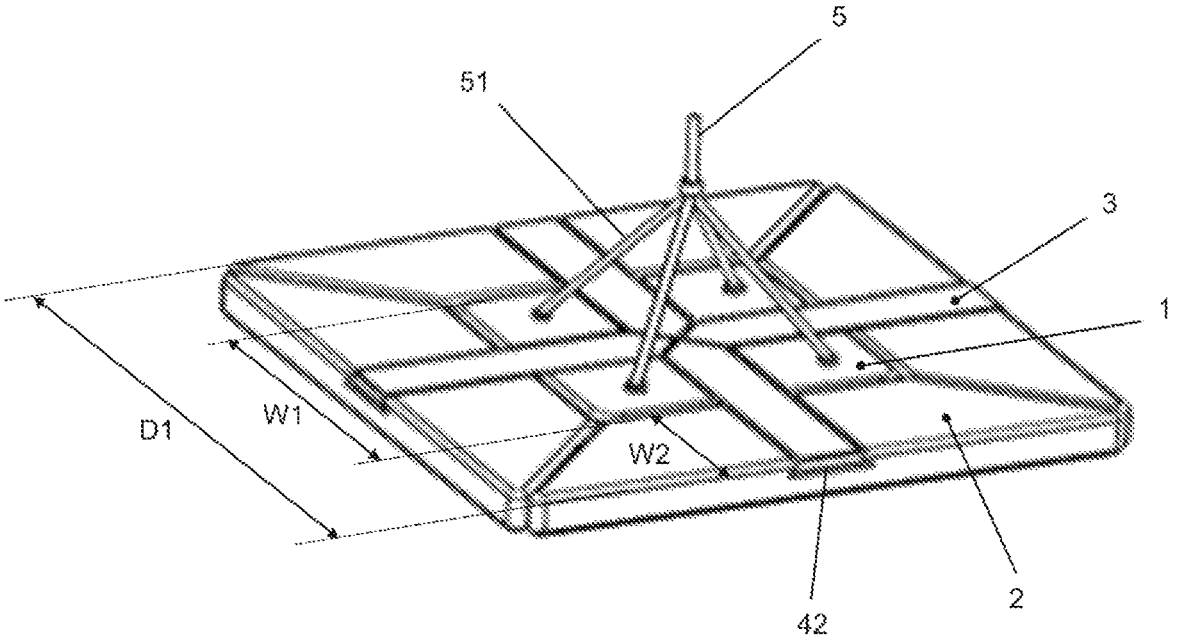
Figure 1B:
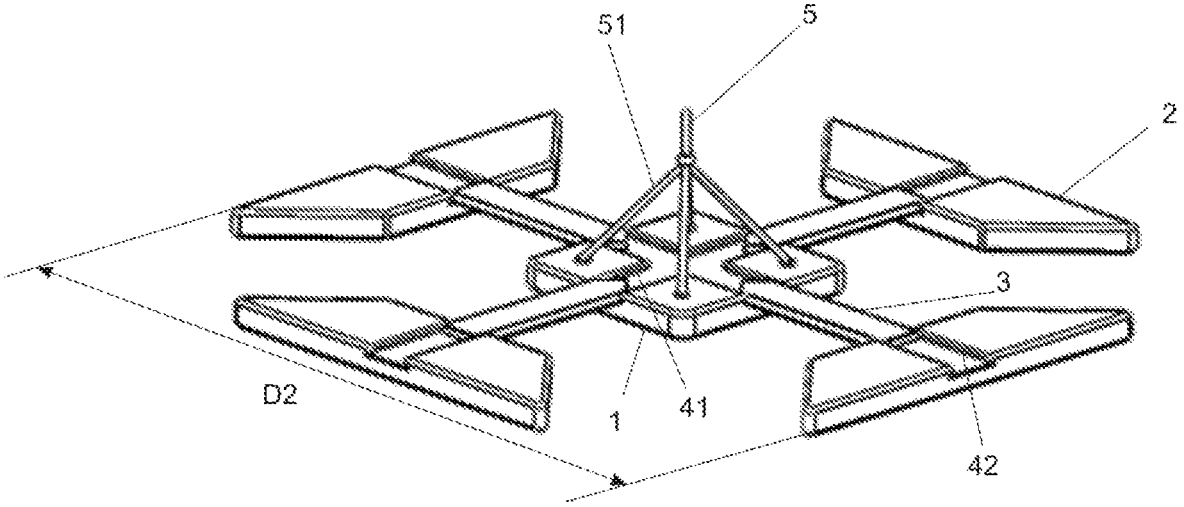

FIG. 1*a* shows an embodiment of a ceiling lamp having a variable shape according to the present invention in a collapsed state. FIG. 1*b* shows the ceiling lamp of FIG. 1*a* in an expanded state.

The ceiling lamp comprises a primary lighting module 1 and four secondary lighting modules 2. The perspective view of FIGS. 1*a* and 1*b* shows the upper side of the lighting modules 1, 2. Each lighting module 1, 2 comprises multiple light emitting diodes (LEDs, not shown) on its lower side. The LEDs may be provided on a PCB (not shown) and may be covered by a diffusing cover (not shown in FIGS. 1*a*, 1*b*) in order to achieve smooth illumination.

Each secondary lighting module 2 is mechanically and electrically connected to the primary lighting module 1 by means of a sliding block 3 that is guided in a slide track 41 in the primary lighting module 1 and in a slide track 42 in the secondary lighting module 2. The electrical connection elements are not shown in the drawings.

The sliding blocks 3 and the slide tracks 41, 42 have corresponding dovetail shapes in order to securely receive the sliding blocks 3 in the corresponding slide tracks 41, 42. In other words, the shape of a sliding block 3 seen in cross-section is that of a trapezoid, having an inner base (towards to respective lighting module 1, 2, lower side in FIGS. 1*a* and 1*b*) that is bigger than its outer base (towards the outside, upper side in FIGS. 1*a* and 1*b*).

The outer ends of the slide tracks 41 of the primary lighting module 1 and the inner end of the slide tracks 42 of the secondary lighting module 2 each comprise slide stops (not shown), which interact with corresponding slide stops (not shown) on both ends of each sliding block 3.

The ceiling lamp may be hung to a holding element (for example a hook attached to a ceiling) by means of a cord 5 which is split into or connected with four lower cords 51. The lower cords 51 in turn are attached to the housing of the primary lighting module 1.

The cord 5 and one or more of the lower cords 51 may include wires for supplying the ceiling lamp with electrical power. Alternatively, an additional supply cord including wires may be used for supplying the ceiling lamp with electrical power.

An electronic driver (not shown) is housed inside the primary lighting module 1 and designed to convert the electrical power supplied to the ceiling lamp (e.g., AC mains power) into power suitable for operating the LEDs (e.g., DC power).

The length of each sliding block 3 is slightly smaller than the sum of the width W2 of a secondary lighting module and half of the width W1 of the primary lighting module. In other words, the length of each sliding block is slightly smaller than half of the external dimension D1 of the ceiling lamp in the collapsed state as shown in FIG. 1*a*.

Thus, in the expanded state as shown in FIG. 1*b*, the separation of each secondary lighting module 2 from the primary lighting module 1 corresponds to roughly W1/2+W2. Therefore, the external dimension D2 of the ceiling lamp in the expanded state is slightly smaller than three times the external dimension D1 in the collapsed state.

Accordingly, the effective area of light emission in the expanded state is slightly smaller than nine times the effective area of light emission in the collapsed state. Experiments and simulations have shown that this results in a substantial weakening of shadows generated by an object between the lamp and a working area.

The primary lighting module 1 has essentially the shape of a square. Each of the four secondary lighting modules 2 has essentially the shape of a trapezoid, with the length of the smaller (inner) base corresponding to the length of the sides of the square primary lighting module 1. These shapes allow the secondary lighting modules 2 to abut the primary lighting module 1 as well as the neighboring secondary lighting modules 2 in the collapsed state of the lamp. This allows for a compact shape of the lamp in the collapsed state.

While only collapsed state and expanded state have been described above, the secondary lighting modules 2 may also be brought into an intermediate position with respect to the primary lighting module 1. Thus, the shape of the lamp may be changed continuously between the collapsed state and the expanded state.

Figure 2A:
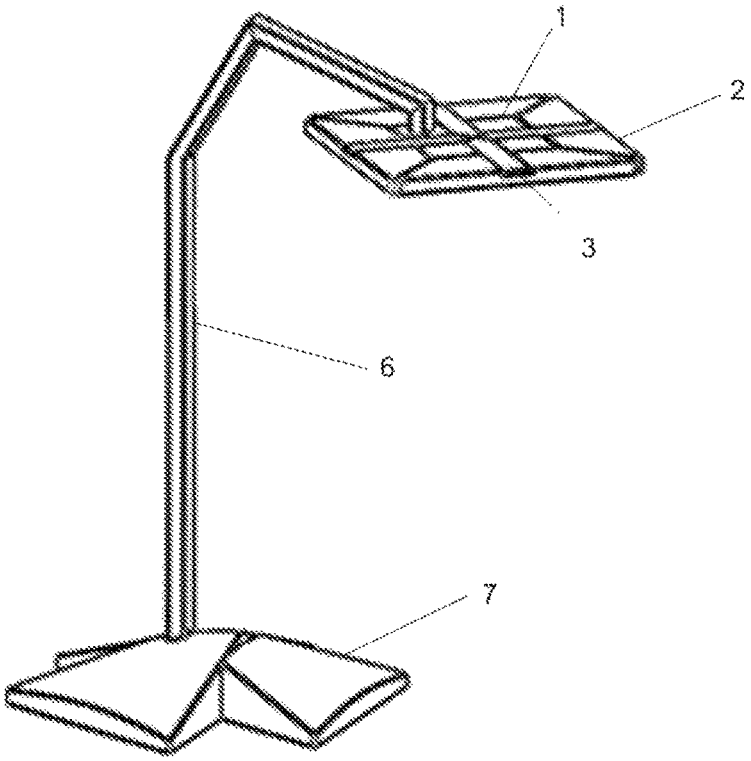
FIGS. 2*a* and 2*b* schematic views of an embodiment of a desk lamp according to the present invention.
Figure 2B:
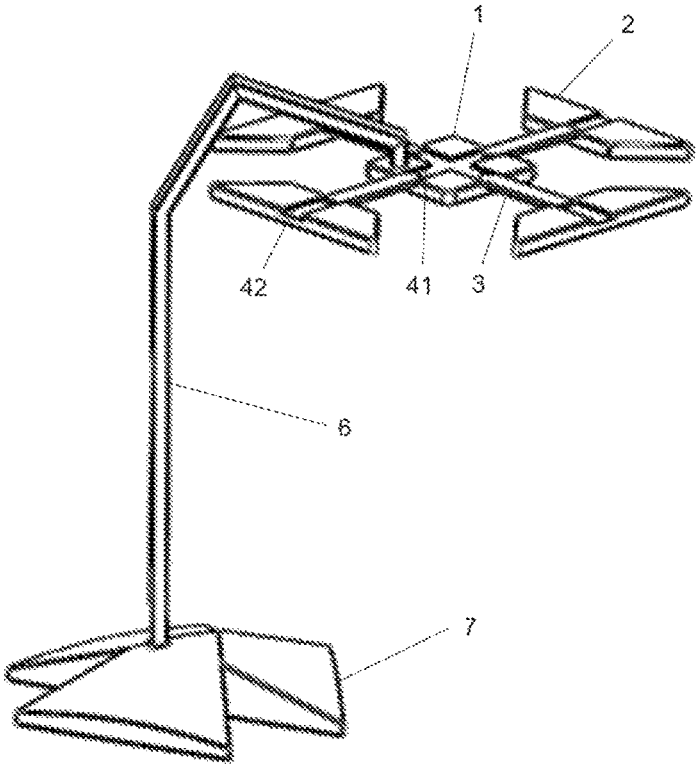

FIG. 2*a* shows an embodiment of a desk lamp having a variable shape according to the present invention in a collapsed state. FIG. 2*b* shows the desk lamp of FIG. 2*a* in an expanded state.

The lighting unit of the desk lamp (comprising primary lighting module 1 and secondary lighting modules 2, sliding blocks 3, and slide tracks 41, 42) corresponds to the lighting unit of the ceiling lamp discussed above and its explanation will not be repeated here.

The primary lighting module 1 of the desk lamp is attached to a holder 6. The holder is attached to a base 7, which can be put onto a surface (for example of a desk). Wires for supplying the LEDs with electrical power may run inside the base and the holder 6. An additional cable (not shown) from the base may be used for connecting the lamp to electrical mains power.

As discussed above, the electronic driver may be provided in the primary lighting module 1 and/or in the secondary lighting modules 2. In the embodiment of a desk lamp, the driver may also be provided inside the base 7.

The shape of the desk lamp may be changed between a collapsed state (FIG. 2*a*) and an expanded state (FIG. 2*b*). As has been explained above, the effective area of light emission in the expanded state is slightly smaller than nine times the effective area of light emission in the collapsed state. Thus, shadows of objects between lamp and working area may be significantly reduced or weakened when the lamp is in the expanded state.

For a desk lamp, in particular, it is advantageous that the lighting modules 1, 2 can be brought together in the collapsed state of the lamp, such that the lamp requires less space and/or looks less obtrusive.

Figure 3A:
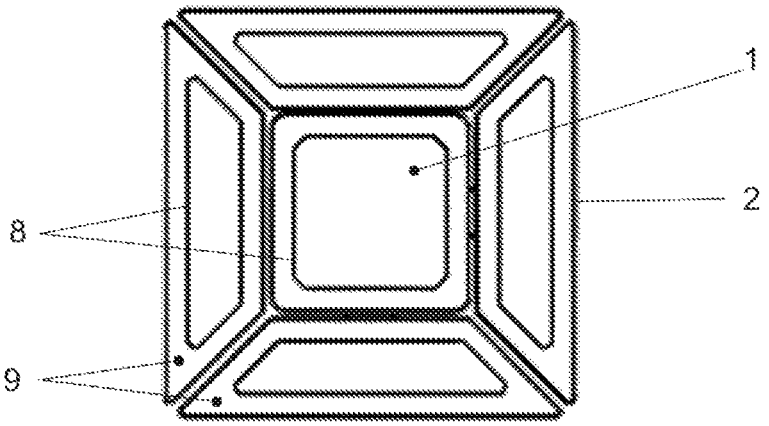
FIGS. 3*a* and 3*b* schematic views of a lighting unit of an embodiment of a lighting device according to the present invention.
Figure 3B:
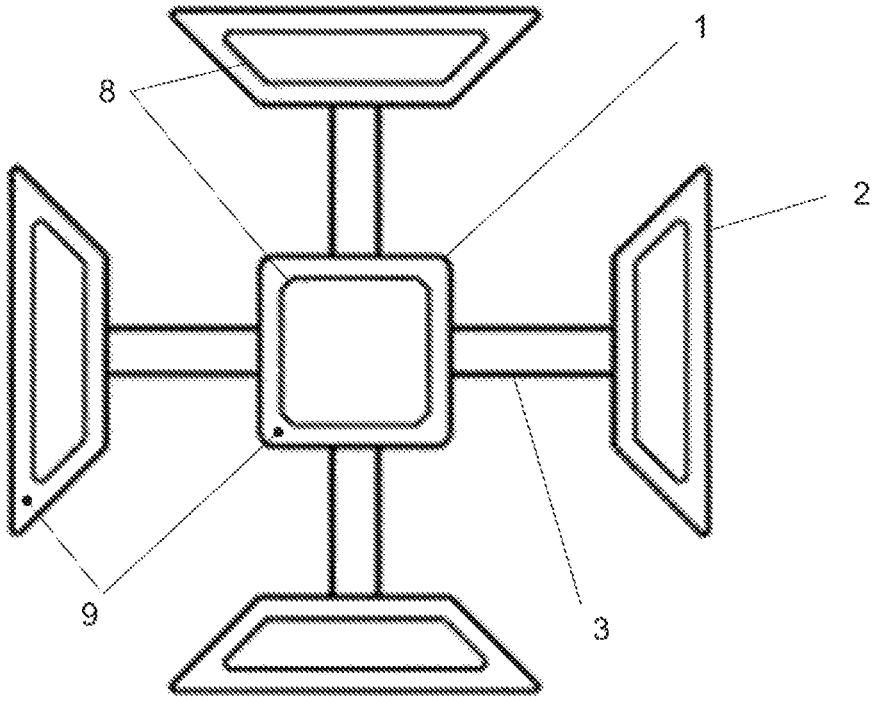

FIG. 3*a* shows an embodiment of a lighting unit (comprising primary lighting module 1 and secondary lighting modules 2, sliding blocks 3, and slide tracks 41, 42) of an embodiment of a lighting device according to the present invention in a collapsed state. FIG. 3*b* shows the lighting unit of FIG. 3*a* in an expanded state.

The explanation of elements of the lighting unit described above will not be repeated here. The lighting unit shown in FIGS. 3*a* and 3*b* may be employed in a ceiling lamp (as shown in FIGS. 1*a* and 1*b*) an in a desk lamp (as shown in FIGS. 2*a* and 2*b*) as well as in any other type of lamp.

FIGS. 3*a* and 3*b* show the light emitting side of the lighting unit, i.e., the lower side as shown in the previous drawings. These drawings show in particular the diffusing cover 8 provided with each lighting module 1, 2 over the LEDs (not shown) for achieving diffuse illumination.

The width of the housing edge 9 around each diffusing cover 8 may be chosen such that a desired design is achieved. In particular, the housing edge may be wider or narrower than in the shown embodiment. In an embodiment, the diffusing cover 8 may extend over the full extension of the lighting modules 1, 2.

Although the invention has been illustrated and described in detail by the embodiments explained above, it is not limited to these embodiments. Other variations may be derived by the skilled person without leaving the scope of the attached claims.

Generally, "a" or "an" may be understood as singular or plural, in particular with the meaning "at least one", "one or more", etc., unless this is explicitly excluded, for example by the term "exactly one", etc.

In addition, numerical values may include the exact value as well as a usual tolerance interval, unless this is explicitly excluded.

Features shown in the embodiments, in particular in different embodiments, may be combined or substituted without leaving the scope of the invention.

LIST OF REFERENCE NUMERALS

1 primary lighting module
2 secondary lighting modules
3 sliding blocks
41 slide tracks in primary lighting module
42 slide tracks in secondary lighting modules
5 cord
51 lower cords
6 holder
7 base
8 diffusing cover
9 housing edge
W1 width of primary lighting module
W2 width of secondary lighting module
D1 external dimension in the collapsed state
D2 external dimension in the expanded state

The invention claimed is:

1. A lighting device comprising:

a primary lighting module with one or more light sources; and at least one secondary lighting module with one or more light sources, wherein the at least one secondary lighting module is mechanically and electrically connected to the primary lighting module;

wherein the at least one secondary lighting module is connected to the primary lighting module via a slide connection such that the at least one secondary lighting module is slidingly movable with respect to the primary lighting module;

wherein the slide connection is provided by a sliding element which is slidingly received by at least one slide track of at least one of the primary lighting module and the at least one secondary lighting module; and wherein the sliding element and the at least one slide track comprise corresponding electrical contacts configured to provide electrical connection between the primary lighting module and the at least one secondary lighting module in slidingly moving the at least one secondary lighting module with respect to the primary lighting module.

2. The lighting device of claim 1, wherein the at least one slide track comprises:

a first slide track provided at the primary lighting module, wherein the sliding element is slidingly received by the first slide track; and a second slide track provided at the at least one secondary lighting module, wherein the sliding element is slidingly received by the second slide track.

3. The lighting device of claim 1, wherein either:

the at least one slide track is provided at the primary lighting module and the sliding element is fixedly provided at the at least one secondary lighting module, wherein the sliding element is slidingly received by the at least one slide track; or the at least one slide track is provided at the at least one secondary lighting module and the sliding element is fixedly provided at the primary lighting module, wherein the sliding element is slidingly received by the at least one slide track.

4. The lighting device of claim 1, wherein the at least one secondary lighting module is slidingly movable between a collapsed state of the lighting device and an expanded state of the lighting device, wherein an effective area of light emission in the collapsed state is smaller than an effective area of light emission in the expanded state.

5. The lighting device of claim 4, wherein the effective area of light emission in the expanded state is at least twice the effective area of light emission in the collapsed state.

6. The lighting device of claim 4, wherein the primary lighting module and the at least one movable secondary lighting module are shaped such that the primary lighting module and the at least one secondary lighting module abut each other in the collapsed state of the lighting device without any gaps therebetween.

7. The lighting device of claim 1, wherein the at least one secondary lighting module is slidingly movable with respect to the primary lighting module in a same plane as the primary lighting module.

8. The lighting device of claim 1, wherein the at least one secondary lighting module is slidingly movable in a linear manner away from and toward the primary lighting module.

9. The lighting device of claim 1, further comprising a first driver hosted by the primary lighting module and configured to drive at least the one or more light sources of the primary lighting module.

10. The lighting device of claim 9, wherein:

the first driver is configured to drive the one or more light sources of the primary lighting module; and the lighting device further comprises a second driver hosted by the at least one secondary lighting module and configured to drive the one or more light sources of the at least one secondary lighting module.

11. The lighting device of claim 1, wherein the electrical contacts comprise a contact strip and a contact element, wherein the contact element is configured to glide along the contact strip in slidingly moving the at least one secondary lighting module with respect to the primary lighting module.

12. The lighting device of claim 11, wherein the contact element is resiliently biased against the contact strip.

13. A lighting device comprising:

a first lighting module comprising a first light source;

a second lighting module comprising a second light source;

wherein the second lighting module is connected to the first lighting module via a slide connection such that the second lighting module is slidingly movable with respect to the first lighting module;

wherein the slide connection is provided by sliding engagement between a sliding element and at least one slide track; and wherein electrical connection between the first lighting module and the second lighting module is provided by interfacing of a contact strip and a contact element, wherein the contact element is configured to glide along the contact strip in slidingly moving the second lighting module with respect to the first lighting module.

14. The lighting device of claim 13, wherein:

the at least one slide track comprises:

a first slide track provided at the first lighting module; and a second slide track provided at the second lighting module; and the sliding element is slidingly received by each of the first slide track and the second track.

15. The lighting device of claim 13, wherein:

the at least one slide track is provided at the first lighting module;

the sliding element is fixedly provided at the second lighting module; and the sliding element is slidingly received by the at least one slide track.

16. The lighting device of claim 13, wherein:

the at least one slide track is provided at the second lighting module;

the sliding element is fixedly provided at the first lighting module; and the sliding element is slidingly received by the at least one slide track.

17. The lighting device of claim 13, wherein the lighting device comprises a plurality of second lighting modules, wherein the plurality of second lighting modules are slidingly movable with respect to the first lighting module in an individual or independent manner.

18. The lighting device of claim 13, wherein the lighting device comprises a plurality of second lighting modules, wherein the plurality of second lighting modules are slidingly movable with respect to the first lighting module in a synchronized or simultaneous manner.

19. The lighting device of claim 13, wherein:

the first lighting module hosts an electronic driver configured to drive both the first light source and the second light source.

20. The lighting device of claim 13, wherein:

the first lighting module hosts a first electronic driver configured to drive the first light source; and the second lighting module hosts a second electronic driver configured to drive the second light source.

* * * * *